US007823428B1

(12) United States Patent
Malik et al.

(10) Patent No.: US 7,823,428 B1
(45) Date of Patent: Nov. 2, 2010

(54) ANALYTICAL METHOD FOR USE IN OPTIMIZING DIMENSIONAL QUALITY IN HOT AND COLD ROLLING MILLS

(75) Inventors: Arif S. Malik, Centerville, OH (US); Ramana V. Grandhi, Centerville, OH (US)

(73) Assignee: Wright State University, Dayton, OH (US)

( * ) Notice: Subject to any disclaimer, the term of this patent is extended or adjusted under 35 U.S.C. 154(b) by 541 days.

(21) Appl. No.: 11/686,381

(22) Filed: Mar. 15, 2007

Related U.S. Application Data

(60) Provisional application No. 60/862,462, filed on Oct. 23, 2006.

(51) Int. Cl.
*B21B 37/24* (2006.01)

(52) U.S. Cl. ..... 72/7.1; 72/8.9; 72/9.1

(58) Field of Classification Search ..... 72/7.1, 72/8.9, 9.1, 9.2, 11.6, 11.7, 11.8, 241.8, 247; 700/154, 155, 156; 703/2, 7
See application file for complete search history.

(56) References Cited

U.S. PATENT DOCUMENTS

| | | | | |
|---|---|---|---|---|
| 4,054,043 | A | 10/1977 | Eibe | |
| 4,222,324 | A * | 9/1980 | Biondetti | 100/47 |
| 4,722,212 | A | 2/1988 | Ginzburg et al. | |
| 4,736,305 | A | 4/1988 | Watanabe | |
| 4,776,192 | A | 10/1988 | Oda et al. | |
| 4,903,517 | A * | 2/1990 | Van Haag et al. | 72/245 |
| 5,235,835 | A | 8/1993 | Sakai et al. | |
| 5,241,847 | A | 9/1993 | Tsugeno et al. | |
| 5,448,901 | A * | 9/1995 | Yu et al. | 72/7.2 |
| 5,560,237 | A * | 10/1996 | Yasuda et al. | 72/13.4 |
| 5,943,896 | A * | 8/1999 | Rosenthal et al. | 72/252.5 |
| 6,038,906 | A | 3/2000 | Hartung et al. | |
| 6,119,500 | A | 9/2000 | Ginzburg et al. | |
| 6,158,260 | A | 12/2000 | Ginzburg | |
| 6,240,756 | B1 | 6/2001 | Tsugeno | |
| 6,338,262 | B1 | 1/2002 | Donini et al. | |

(Continued)

FOREIGN PATENT DOCUMENTS

SU 688906 * 9/1979

OTHER PUBLICATIONS

Stone, M.D., "Therory and Practical Aspects in Crown Control", Iron and Steel Engineer Year Book, 1965, pp. 657-667.

(Continued)

*Primary Examiner*—Edward Tolan
(74) *Attorney, Agent, or Firm*—Dinsmore & Shohl LLP

(57) ABSTRACT

A device and method for prediction and/or control of the profile and/or shape of rolled metal strip. The device and method are compatible with both cluster-type and non cluster-type mills. The device and method employ a customized deflection model of the rolling mill, thereby combining the advantages of well-known finite element method with other relevant methods to allow real-time operation of the rolling mill without the computational complexities of such methods. In one form, the customized deflection model helps to obtain a compact, linear, and flexible analytical model with non-iterative solution, multiple continuous elastic foundations, third-order displacement fields, simple stress-field determination, and capability to compute dynamic deflection characteristics.

9 Claims, 6 Drawing Sheets

U.S. PATENT DOCUMENTS

| | | | | |
|---|---|---|---|---|
| 6,460,753 | B1 * | 10/2002 | Suhir | 228/123.1 |
| 6,721,620 | B2 | 4/2004 | Jelali et al. | |
| 7,279,916 | B2 * | 10/2007 | Suhir | 324/760 |
| 7,403,296 | B2 * | 7/2008 | Farritor et al. | 356/614 |
| 7,587,689 | B2 * | 9/2009 | Sawai | 716/4 |
| 2006/0080069 | A1 * | 4/2006 | Fujimoto | 703/2 |

OTHER PUBLICATIONS

Shohet, K.N. et al., "Roll Bending Methods of Crown Control in Four-High Plate Mills", Journal of The Iron and Steel Institute, Nov. 1968, pp. 1088-1098.

Shohet, K.N. et al., "Flatness Control in Plate Rolling", Journal of The Iron and Steel Institute, Oct. 1971, pp. 769-775.

Berger, B., et al., The Elastic Deformation of Rolls in Four-High Rolling Stands (Die Elastishce Verformung der Walzen von Vier-Walzengerusten), Archiv fur das Eisenhuttenwesen., vol. 47, 1976, pp. 351-356.

Gunawardene, G.W.D.M. et al., "Static model for Sendzimir cold-rolling mill", Metals Technology, Jul. 1981, pp. 274-282.

Kono, T., "Development of mathematical model on crown control in cold strip rolling", The Sumitomo Search, vol. 28, 1983, pp. 1-8.

Kizaki, K. et al., "Roll Deformation Analysis of Rolling Mill", IHI engineering review, vol. 23, Issue 1, Jan. 1983, pp. 1-8.

Sumi, H. et al., "A Numerical Model and Control of Plate Crown in the Hot Strip or Plate Rolling", Advanced Technology of Plasticity 1984, vol. 11, pp. 1360-1365.

Hattori S., et al., "Effects of Roll Arrangements and Roll Sizes on Shape Controllability of Cluster Mills", Advanced Technology of Plasticity 1984, vol. 11, pp. 1230-1235.

Pawelski, O., "A Mathematical Model with a Combined Analytical and Numerical Approach for Predicting the Thickness Profile of a Cold-Rolled Strip", Steel research, vol. 56, No. 6, 1985, pp. 327-331.

Kawanami, T. et al., Characteristics of Shape Control in Cluster Type Rolling Mill (CR Mill), Technical Review, Jun. 1985, pp. 171-177.

Harrison, R.S.T. et al., "70 Automatic Shape Control on Sendzimir Mills", pp. 570-577.

Guo, R-M, "Computer model simulation of strip crown and shape control", Iron and Steel Engineer, Nov. 1986, pp. 35-42.

Wilkund, O. et al., "Simulation of crown, profile and flatness of cold rolled strip by merging several physically based computer models", International Steel Rolling Conference 4th, Jun. 1-3, 1987, pp. E.9.1-E.9.6.

Chen, X., "A Specificalized Finite Element Model for Investigating Controlling Factors Affecting Behavior of Rolls and Strip Flatness", International Steel Rolling Conference 4th, Jun. 1-3, 1987, pp. E.4.1-E.4.7.

Kihara, J., "Application of BEM to Calculation of the Roll Profile in Flat Rolling", International Steel Rolling Conference 4th, Jun. 1-3, 1987, pp. E.1.1-E.1.12.

Guo, R-M, "Cascade effect of crown and shape control devices in tandem rolling mills", Iron and Steel Engineer, Jul. 1988, pp. 29-38.

Guo, R-M, "Characteristics of rolling mills with roll shifting", Iron and Steel Engineer, Dec. 1988, pp. 45-54.

Matsubara, S. et al., "Optimization of work roll taper for extremely thin strip rolling", ISIJ International, vol. 29, No. 1, 1989, pp. 58-63.

Guo, R-M, "Development of a mathematical model for strip thickness profile", Iron and Steel Engineer, Sep. 1990, pp. 32-39.

Kihara, J., "Application of Boundary Element Method to Rolling Technology with Special Respect to Flatness and Crown of Plate and Sheet", ISIJ International, vol. 31, No. 6, 1991, pp. 543-549B.

Matsumoto, H., "2-Dimensional lateral-material-flow model reduced from 3-dimensional theory for flat rolling", ISIJ International, vol. 31, No. 6, 1991, pp. 550-558.

Ogawa, S. et al., "Prediction of Flatness of Fine Gauge Strip Rolled by 12-high Cluster Mill", ISIJ International, vol. 31, No. 6, 1991, pp. 599-606.

Hara, K. et al., "Shape Controllability for Quarter Buckles of Strip in 20-high Sendzimir Mills", ISIJ International, vol. 31, 1991, No. 6, pp. 607-613.

Fukuhara A. et al., "Development of shape control system for cluster-type cold reduction mill", Iron and Steel Engineer, Oct. 1991, pp. 34-40.

Hattori, S., et al., "Fuzzy Control Algorithm and Neural Networks for Flatness Control of a Cold Rolling Process", Hitachi review, vol. 41, No. 1, Feb. 1992, pp. 31-38.

Yamada K. et al., "Three dimensional analysis of flat rolling using rigid-plastic finite element method coupled with roll deformation analysis", International Conference on Numerical Methods in Industrial Forming Processes, 4th, 1992, pp. 755-761.

Yanagimoto, J. et al., "Three-dimensional simulation system for coupled elastic/rigid-plastic deformations of rolls and workpieces in strip rolling processes", International Conference on Numerical Methods in Industrial Forming Processes, 4th, 1992, pp. 763-768.

Hattori, S. et al., "Application of Pattern Recognition and Control Techniques to Shape Control of Rolling Mills", Hitachi Review, vol. 42, Aug. 1993, No. 4, pp. 165-170.

Guo, R-M et al., "Analysis of chatter vibration phenomena of rolling mills using finite element methods", Iron and Steel Engineer, Jan. 1993, pp. 29-39.

Ringwood, J.V. et al., "Feedback Design of a Canonical Multivariable System With Application to Shape Control in Sendzimir Mills", Journal of Dynamic Systems, Measurement, and Control, Mar. 1994, vol. 116, pp. 104-110.

Hacquin, A. et al., "Experimental validation of a Rolling Stand Elastic Deformation Model", Journal of Materials Processing Technology, 45, 1994, pp. 199-206.

Lin, Zone-Ching et al., "Analysis of the variation of the cold-rolling characteristics of rolling force, strip shape, stress and temperature, for a three-dimensional strip", Journal of Materials Processing Technology, 54, 1995, pp. 326-340.

Pu, H.J. et al., "Development of an Integrated Flatness and Thickness Control System for the 20 Roll Sendzimir Cluster Mill", pp. 121-132.

Zhou, S. et al., "Influence of roll geometry and strip width on flattening in flat rolling", Steel research 67, 1996, No. 5, pp. 200-204.

Guo, R-M, "Prediction of Strip Profile in Rolling Process Using Influence Coefficients and Boussinesq's Equations", Journal of manufacturing Science and Engineering, vol. 119, No. 2, May 1997, pp. 220-226.

Deshpande, A.S. et al., "Computer Analysis for the Prediction of a Strip Profile in Cold Rolling", Journal of Materials Processing Technology, 63, 1997, pp. 712-717.

Nappez, C. et al., "Control of strip flatness in cold rolling; A global approach", Iron and Steel Engineer, vol. 74, No. 4, Apr. 1997, pp. 42-45.

Gorni, A.A., "The Application of Neural Networks in the Modeling of Plate Rolling Processes", JOM-e, 49 (4), 1997, http://www.tms.org/pubs/journals/JOM/9704/Gorni-9704.html, pp. 1-9.

Guo, R-M, "Optimal Profile and Shape Control of Flat Sheet Metal Using Multiple Control Devices", pp. 1-9.

Hacquin, A. et al., "A three-dimensional semi-analytical model of rolling stand deformation with finite element validation", Eur. J. Mech., A/Solids, 17, No. 1, 1998, pp. 79-106.

Ringwood, J.V., "Shape Control Systems for Sendzimir Steel Mills", IEEE Transactions On Control Systems Technology, vol. 8, No. 1, Jan. 2000, pp. 70-86.

Jelali, M., "Explicit models of thickness profile and tension stress distribution for process control applications", Steel Research, 71, 2000, No. 6+7, pp. 228-232.

Wang, D.D. et al., "Toward a heuristic optimum design of rolling schedules for tandem cold rolling mills", Engineering Applications of Artificial Intelligence, 13, 2000, pp. 397-406.

Lin, J.C., "Prediction of Rolling Force and Deformation in Three-Dimensional Cold Rolling by Using the Finite-Element Method and a Neural Network", The International Journal of Advanced Manufacturing Technology, 2002, 20, pp. 799-806.

Zhu, H.T., "A fuzzy algorithm for flatness control in hot strip mill", Journal of Materials Processing Technology, 140, 2003, pp. 123-128.
Dvorkin, E.N. et al., "Finite element models in the steel industry Part I: Simulation of flat product manufacturing processes", Computers and Structures, 81, 2003, pp. 559-573.
Jiang, Z.Y. et al., "Finite element simulation of cold rolling of thin strip", Journal of Materials Processing Technology, 140, 2003, pp. 542-547.
Jiang, Z.Y. et al., "A 3-D finite element method analysis of cold rolling of thin strip with friction variation", Tribology International, 37, 2004, pp. 185-192.
Guo, R-M et al., "Development of New Crown/Shape Control Model for Cluster Mills", AISTech 2004 Proceedings, vol. II, pp. 43-51.

* cited by examiner

ANALYTICAL METHOD FOR USE IN OPTIMIZING DIMENSIONAL QUALITY IN HOT AND COLD ROLLING MILLS

This application claims the benefit of U.S. Provisional Application Ser. No. 60/862,462, filed Oct. 23, 2006.

BACKGROUND OF THE INVENTION

The present invention generally relates to a device and method for improving the profile and flatness of a rolled article, and more particularly to a device and method that can calculate the cross-sectional thickness profile of the rolled article based on the machine parameters and provide instructions to control the article's profile and flatness accordingly. The invention even more particularly relates to predictive measurement and optional corrective actions by a controller on rolled metal plate, strip or sheet articles.

Metal and non-metal articles in plate, strip or sheet form may be produced by rolling. The use of rolling equipment, especially rolling mills, is particularly prevalent in the production of metal articles. In order to achieve a high level of dimensional quality in the rolling of metal plate, strip, or sheet (hereafter collectively referred to as "strip"), the variation of the cross-sectional strip thickness, also referred to as the thickness profile or profile, must lie within acceptable limits. One common measurement of the strip thickness profile is the strip "crown", which is defined as the difference between the thickness at the strip center and an average edge thickness. In addition to the strip thickness profile, a second important dimensional quality criterion of the rolled metal strip is the related variation in length, also referred to as the flatness or shape.

Intense global competition and the difficulties associated with rolling increasingly thinner, higher quality metal strip place demands upon metal producers to commission innovative profile and flatness controlling technologies. Measures undertaken by metals manufacturers to meet the strip profile and flatness requirements typically include the employment of on-line controls systems that operate rolling mill actuators for the purpose of optimizing the thickness profile and/or flatness during rolling, the optimization of suitable ground profiles onto the rolls that make possible the desired profile and flatness, and the optimization of strip thickness reduction schedules that facilitate the desired profile and flatness. Additional measures taken by the manufacturers of the rolling mill equipment and of supplemental profile and flatness control mechanisms respectively may include optimum design of the rolling mills to achieve desired profile and flatness, and design of effective supplemental hardware mechanisms capable of attaining desired strip profile and flatness.

In order to produce a desired strip profile and flatness, the aforementioned measures taken by metal producers, rolling mill manufacturers and suppliers of supplemental profile and flatness control mechanisms require analytical tools to predict and control the profile and flatness for a specific mill configuration, mechanical control mechanism(s), and rolled material properties. Because of the complexity in modeling rolling mills, particularly those having cluster-type roll configurations, conventional systems to predict and control strip profile and flatness have employed analytical methods with various types of simplifying assumptions.

The conventional analytical techniques incorporated into systems to predict and control the profile and flatness of rolled metals can be categorized into five broad methods: (1) single-beam on elastic foundation method; (2) influence coefficient/point match method; (3) transport matrix method; (4) pattern recognition/heuristic method and (5) large-scale finite element method. Each of these conventional methods used to predict and/or control rolled metal profile and flatness are deficient due to one or more general shortcomings.

The first general shortcoming is limited applicability. Because of the inherent complexity of typical rolling mills (especially cluster-type rolling stand configurations), few of the conventional analytical methods readily encompass the details necessary to attain an accurate result, while a more simplistic method, such as the single beam on elastic foundation method, is not well-suited to the intricacies of cluster-type and related modern rolling stand configurations. Of the methods that have been devised for use in cluster-type mills, such as the influence coefficient/point match and transport matrix methods, excessively complex models with limited transferability have arisen. For this reason, the prevalence of non-physics based pattern recognition/heuristic models is greater in predicting and controlling profile and flatness in cluster-type rolling mills, although they suffer from other shortcomings, as discussed below.

The second general shortcoming is excessive computation time. The most widely employed method, the influence coefficient/point match method, requires an iterative computational procedure in conjunction with convergence (loop terminating) criteria to obtain a result. Due to the number of iterations and associated computation time, the influence coefficient/point match method is not directly suitable for on-line and related real-time prediction and control in rolling mills. While the transport matrix method has been used on-line for vertical-stack (non cluster type) rolling mills, it is also not suitably fast enough for mills having relatively large numbers of rolls, such as the 20-roll Sendzimir cluster-type mill. Large-scale finite element methods require the most computation time of any conventional method. Even for off-line studies, wherein execution time is not critical, the finite element method's use is questionable because of the convergence issues and lengthy computation time associated with contact-type structural analyses.

The third general shortcoming is insufficient accuracy. The single beam on elastic foundation method is inaccurate in all instances because it neglects shear deformation of the work rolls and considers deflection of the backup rolls (shear, bending, and flattening) as a constant elastic foundation. The influence coefficient/point match method and transport matrix method suffer inaccuracy because the strip profile is predicted in a piecewise continuous ("connect-the-dots") manner, with accuracy conditional upon a relatively large number of closely-spaced nodes. As node count is increased to improve accuracy, computation time and speed are adversely affected. In addition, since the transport matrix method employs a model of discretely separated nodal springs instead of a continuous elastic foundation that is mathematically integrated, accuracy is sacrificed, particularly in the vicinity of component ends where accuracy is most important.

The fourth general shortcoming is the prerequisite of training the profile and flatness prediction and control system with large amounts of data collected from the rolling operation. Since pattern recognition/heuristic models are non-physics based, they exhibit deficiencies in both trend and accuracy in the absence of training with actual data. Such required data may not be available prior to commissioning a strip profile and flatness control system, particularly for newly-started rolling mills.

The fifth general shortcoming is the inability of any of the conventional methods to predict the dynamic deflection behavior of the rolling mills. While not traditionally considered by methods that statically predict strip profile and flatness, the ability to predict adverse dynamic characteristics of rolling mills can prevent severe problems in dimensional quality in addition to costly mill equipment damage. With the exception of large-scale commercial finite element methods, none of the conventional methods previously described are able to predict and control dynamic deflection of rolling mill stands.

While the conventional approaches are currently being employed, their effectiveness is limited by one or more of the aforementioned problems and disadvantages. Thus, what is needed is a profile and flatness prediction and control system and method that can operate accurately to attain the desired strip profile and flatness for both cluster-type and non cluster-type rolling mills. What is further needed is such a system that can operate rapidly in real-time (i.e., on-line) strip-producing conditions.

SUMMARY OF THE INVENTION

This need is met by the present invention, wherein an analytical profile and flatness prediction and control system and accompanying method for use in metal strip rolling mills without the disadvantages of the prior art is described. The invention combines the advantages of the conventional finite element method with the advantages of conventional solid mechanics, wherein a compact, accurate, rapid, and flexible method suitable for use in various types of on-line and off-line profile and flatness control techniques is obtained. In accordance with a first aspect of the invention, an article of manufacture for predicting and/or controlling the profile and flatness of rolled metals is disclosed. The article includes a computer usable medium having computer readable program code for conducting a static analysis of the metal strip. In the present context, a static analysis includes determining linearized displacements of the metal strip or related workpiece being analyzed. In addition, displacements of one or more rolling mill components may be determined. One well-known linearized displacement is that used in static analysis, where the displacement can be solved by multiplication of an inverted stiffness value and an imposed force. Such displacements may be one or more of a profile value and a flatness value of the metal strip. The metal strip may exist in a first state prior to passage through a rolling mill and a second state after passage through the rolling mill such that the second state has one or more surface dimension different than that of the first state. For example, the thickness dimension of the strip in the second state may be smaller (i.e., thinner) than in the first state. The code is configured such that displacement values of the metal strip corresponding to at least one of a profile value and a flatness value associated with the second state are generated based on input parameters that identify a relationship between the rolling mill and the metal strip. The code is further configured such that the metal strip and rolling mill component(s) may be modeled as a combination of numerous beam elements and numerous continuous elastic foundations coupled between respective beam elements.

The article has particular utility as a programmed algorithm in computerized profile and flatness control systems that deliver and/or receive commands to and/or from rolling mill actuators and/or optional sensors. Added utility is realized in other such circumstances including, but not limited to, rolling mill design, pass schedule optimization, and optimal design of ground roll profiles. Regarding a static displacement analysis, the input parameters optionally include one or more of a load and material and geometric properties of both the metal strip and rolling mill. In another option, the displacement values can be calculated based on a product of the inverse of an aggregated stiffness and the load, wherein the stiffness is aggregated over the plurality of beam elements and the plurality of continuous elastic foundations. The code may further cause the computer to which it is cooperative to compare the generated displacement values to a measured set of displacement values. Such comparison can be used for error correction or related accuracy-enhancing. In another option, the code may further cause the computer to instruct the rolling mill to change one or more relationships between the rolling mill rollers such that one or both of a profile value and a flatness value associated with the second state of the metal strip can be adjusted. More particularly, the changed relationship between rollers is selected from the group consisting of roll crossing, roll bending and roll shifting. In yet another option, the code may further cause the computer to calculate vibratory response characteristics of the metal strip in the transition from the first state to the second state, one or more components of the rolling mill, or both. More particularly, the code may be further configured such that vibratory response characteristics calculated by the computer are based on a superposition of at least one calculated value of eigenvectors onto the displacement values. The code may further be configured to iteratively operate to calculate the displacement values of the rolling mill components and the metal strip in the second state, thereby enhancing accuracy of a strip rolling process.

According to yet another aspect of the invention, a controller used to predict a shape associated with an article produced in a rolling mill is disclosed. The controller includes a microprocessor and an algorithm configured such that a set of displacement values corresponding to a linear displacement relationship are calculated. The set of displacement values equals a set of inverted stiffness values that are also calculated by the algorithm multiplied by an applied load or force. The algorithm is configured to perform this linear displacement relationship at a series of nodes used to geometrically and materially define the article. Individual nodal values are based on a combination of beam elements and continuous elastic foundations that are coupled between the beam elements as a way to simplify the calculations relative to finite element methods or related computation techniques. Calculations and values at each node are aggregated so that global values can be determined. These global values can be used to predict the shape of the article.

According to another aspect of the invention, a device for rolling metal strip is disclosed. The device includes a strip-conveying member, numerous rollers, one or more actuators and a controller. Passage of the metal strip along the strip-conveying member between the rollers causes at least one surface dimension of the strip to be modified. The actuator (or combination of actuators) can be used to arrange the rollers relative to one another, thereby allowing adjustments to be made in processing the strip. The controller is configured such that upon generation of a set of displacement values associated with one or more of the profile and flatness values of the modified surface dimension(s), the controller can instruct the actuator(s) to arrange the plurality of rollers to such that a deviation from a desired modified surface dimension is reduced without an appreciable change in the speed with which the metal strip is passed through the rollers. The controller further comprises an arithmetic logic unit that is configured to achieve the generation of a set of displacement values by modeling contact between the metal strip and the rollers as a combination beam elements and continuous elastic foundations coupled between the beam elements. This allows for a real-time control of the processing quality of the rolled strip by simplifying and reducing the number of calculations the arithmetic logic unit must perform.

Optionally, the device further includes one or more sensors cooperative with the metal strip such that the modified surface dimension(s) can be measured. The arithmetic logic unit of the controller is further configured to perform a dynamic analysis on at least one of the metal strip and the device. In one form, the arithmetic logic unit may be part of or cooperative with a microprocessor that can be part of the controller. Preferably, the values of the different surface dimension(s) are aggregated by the microprocessor working in conjunction with the algorithm to determine the profile and flatness values of the metal strip in the second state. In one form, the beam elements comprise Timoshenko beams, while the continuous elastic foundations comprise coupled Winkler foundations. Calculated values of the continuous elastic foundations may be iteratively updated while the metal strip is being rolled by the device. The controller is further configured to determine a dynamic response of at least one of the metal strip and the plurality of rollers, such as by superposition of frequency-based values onto the static displacement values. In another option, the rollers can be configured as tandem rollers, cluster rollers or the like. The controller may also receive measured (or sensed) surface dimension information from one or more sensors. After determining a preferred strip profile, shape or both, the controller may instruct the rolling mill to rearrange its roller configuration in order to reduce or minimize deviations from a desired strip profile and/or shape. Assessed information may include displacement fields, stress/strain fields, member loads, strip profile and strip flatness.

According to another aspect of the invention, a method of rolling metal strip is disclosed. The method includes passing a metal strip through a rolling mill such that it changes from a first state to a second state, where the second state is different from the first state. In addition, the method includes creating a global stiffness-based displacement model that provides a detailed assessment of the second state, as well as outputting a result corresponding to the global stiffness-based displacement model. In this way, the creation of the global stiffness-based displacement model does not appreciably change the speed with which the metal strip is changed from the first state to the second state. Thus, such an approach could be used to allow real-time adjustment to rolling mill processing parameters based on predicted displacement (i.e., surface dimension or shape) values of the as-processed strip. The model, which can be used to predict and/or adjust processed strip surface dimension(s), includes a series of steps including (a) building a nodal representation of the first state of the strip through a combination of beam elements and continuous elastic foundations, (b) assigning input parameters to numerous nodes within the nodal representation (where at least one of the input parameters corresponds to a load representative of a force imparted to the first state by a roller), (c) determining beam element shape functions, (d) generating a custom element stiffness matrix based upon a summation of a beam element stiffness matrices and a foundation element stiffness matrix, (e) assembling global matrices, (f) repeating steps (c) through (e) until all of the nodes have been analyzed, and (g) solving nodal displacements for the second state.

Optionally, the method further includes sending a command signal based on the result to the one or more rollers and adjusting the roller to change the second state. In another option, the result is selected from the group consisting of displacement fields, stress/strain fields, member loads, strip profile and strip flatness. In yet another option, the method further includes measuring one or more surface dimensions of the metal strip in the second state, comparing the measured dimension(s) and refining the global stiffness-based displacement model based on such comparison. The method may further include repeatedly computing deflection of the roller(s) with at least some of the continuous elastic foundations being updated according to intermediate computations of foundation loads and updated coordinate geometry of the global stiffness-based displacement model. Stated another way, the deflection of the rolling mill components may optionally be computed repeatedly, with any number of elastic foundation parameters being updated between iterations according to intermediate computations of foundation loads and updated coordinate geometry of the analytical model. In still another option, the method further includes calculating vibratory characteristics of a system comprising one or more of the metal strip and the roller(s), using a conventional global mass matrix, and combining the global mass matrix with the global stiffness-based displacement model to predict mode shapes of vibration and natural frequencies of vibration for the system. In another option, known ways of obtaining a global mass matrix and optionally a global damping matrix may be used in conjunction with the invented method to obtain a global stiffness matrix for the purpose of solving the conventional eigenvalue problem to determine eigenvalues and eigenvectors. The determined eigenvectors can be superposed with the static deflection vector to predict mode shapes of vibration of the rolling mill. The strip static deflection values may be computed rapidly by multiplication of the inverse of the global stiffness matrix with the corresponding load vector. The stress field may be determined from the predicted displacement field using known elastic relationships. Transfer function matrices (i.e., gain matrices) may be computed based on applied load and/or displacement vectors that represent on-line profile and/or flatness control mechanisms such as roll bending, roll shifting, roll crossing, or other means. Optimization of rolling mill operating practices, including but not limited to thickness reduction scheduling, may be performed based on information derived from the profile or flatness values.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
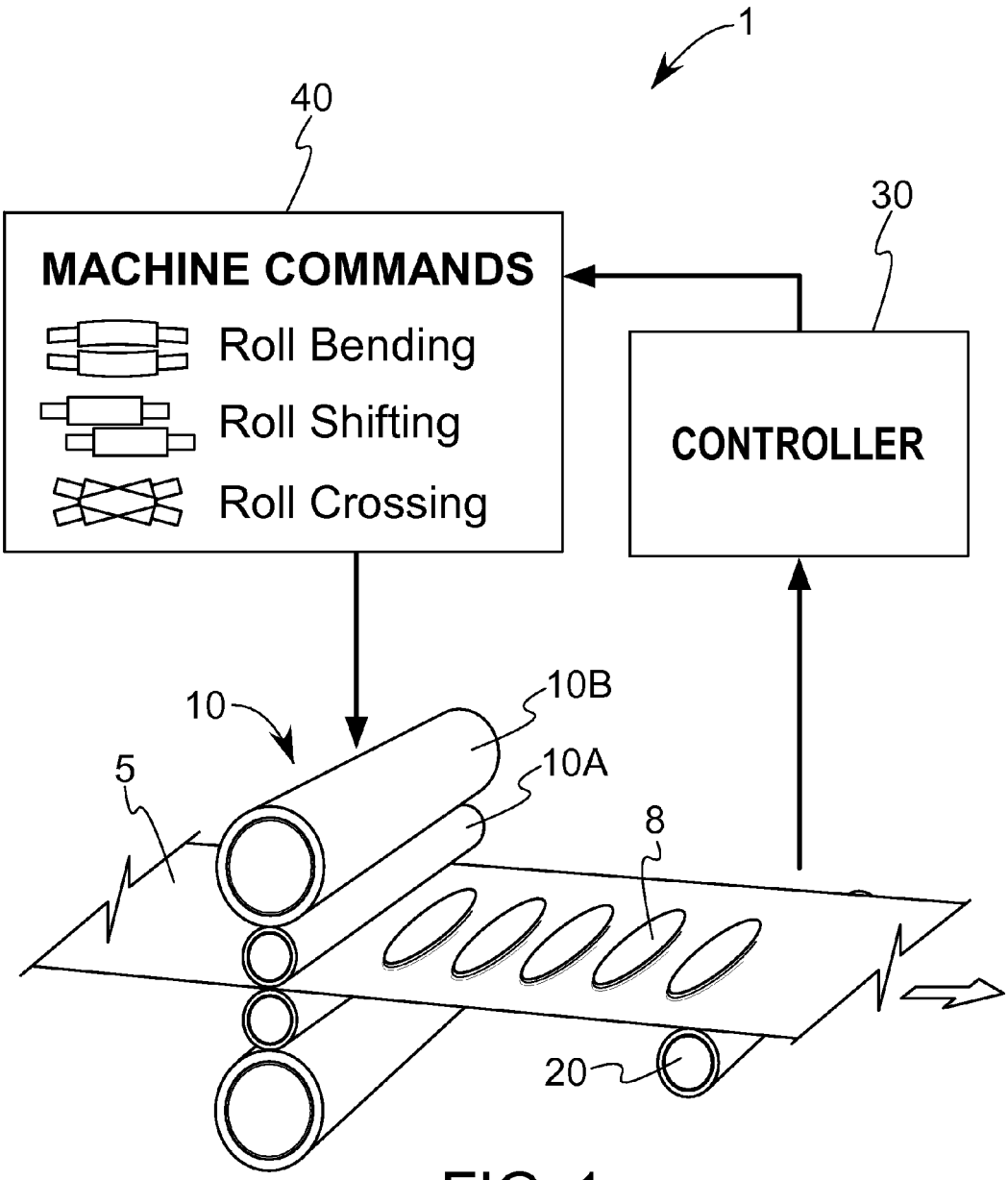
FIG. 1 shows a simplified example of the operation of a system according to an embodiment of the present invention.

Referring first to FIG. 1, a simplified view of a system 1 to predict and control profile and flatness of strip 5 is shown. The system 1 includes a rolling mill made up of numerous rolls (also referred to as rollers) 10 configured to process strip 5 along rolling direction D which may alternate during successive reductions in thickness of strip 5. Other details of the rolling mill (including strip-conveying members in the form of feed and take-up reels, roll actuators, motors, drivers and related componentry for roll bending, crossing or shifting) are eliminated from the drawing to promote clarity. Rollers 10 may further be classified as work and backup rollers 10A and 10B, where the former contacts strip 5 and the latter contacts the former to provide backup. Flatness defects (or undulations) 8 that may be sensed and eventually corrected by system 1 are shown on strip 5 downstream of the rollers 10. The system 1 also includes one or more sensors 20 that may be located on either or both sides of rollers 10 and can measure one or more of a profile and flatness property of strip 5 including shapes and surface dimension changes such as those making up defects 8. A controller 30 is signally coupled to the sensor 20 such that upon receipt of a signal therefrom, an analytical model programmed into a processor, arithmetic logic unit or related computation device in the controller 30 can be used to quantify the nature of the defect 8. In addition, controller 30 may send an appropriate command signal to the rollers 10 as a way to meliorate the defects 8. In one particular form, actuators (not shown) can receive the command signal from controller 30 and in turn adjust one or more of the rollers 10 to effect a different bending, crossing or related shifting position between them. When functioning to send such command signals to the roller-adjusting components (such as actuators, not shown), the controller 30 acts as the logic or "brain" as a way to achieve the desired strip target of one or both of profile and thickness.

The controller 30 is configured to operate as a feedback system, where it receives input from the one or more sensors 20, and provides operating instructions to the rollers 10 within the system in an attempt to achieve a desired roll profile (such as roll bending, roll shifting or roll crossing). As mentioned above, the controller 30 may be microprocessor-based, such that it can be used in a program or related algorithm to calculate a desired setting. In one form, the program is configured as a code that can be read and subsequently operated on by a computer. The controller 30 is configured to determine the nature of the measured defect 8 in real-time, while system 1 is operating, thereby avoiding the cost and inconvenience of recalculating or otherwise reconfiguring the system 1 while off-line. In a related use, the controller 30 can be used in a quasi real-time way, such as to help calculate nominal processing parameters, such as those used in establishing setpoint conditions for the actuators. For example, pass schedule calculations (which may be used in between successive roll passes during multipass processing) can be performed by the controller 30 to provide the necessary command signals to the rollers 10.

Calculated strip surface dimension values derived from the present analytic method can be compared to values derived from input signals taken from the sensors 20 as part of an iterative approach to achieving a preferred strip profile or thickness. For example, a strip profile or thickness value can be predicted by an algorithm embedded in controller 30 and compared to values measured by sensors 20. The controller 30 may include learning attributes that can be used to help better correlate errors such that upon performing an updated prediction, the controller 30 can improve its predicting ability. Thus, in one form, the sensors 20 can be used as a correction technique to improve upon predictions made by the algorithm. It will be appreciated by those skilled in the art that the use of separate sensors 20, while helpful, is not necessary for proper system operation. Thus, in situations where cost or complexity concerns over the use of sensors 20 or related measuring devices is prohibitive, the controller 30 and algorithm coupled thereto can be used as the sole determinant of the preferred strip surface dimensions, while still possessing the high degree of accuracy needed to achieve the desired control of the rolling mill.

Controller 30 can be used to establish appropriate roller 10 setpoints. For example, controller 30 communicates with valves, actuators or related shifting, bending or crossing components (none of which are shown for clarity). Moreover, controller 30 may be a single controller or multiple controllers whose actions are coordinated to provide a desired overall operation of system 1. Furthermore, controller 30 may include one or more modules, as needed, to perform the functionality indicated. As used herein, the term "module" refers to an application specific integrated circuit (ASIC), an electronic circuit, a processor (shared, dedicated or group) and memory that execute one or more software or firmware programs or program segments, a combinational logic circuit, or other suitable components that provide the desired functionality. In one form, a processor or logic module (not shown) can be used to provide overall coordination of the controller 30 activities, as well as include arithmetic functions to determine whether manipulation of one or more components within system 1 is needed. A linkage module (not shown) may be signally connected to a current or related electricity-sensing device to enable load and other operational monitoring. A storage module (not shown) can be used to store data to be recorded, as well as setpoint information. Other modules may be included, depending on the functional requirements of the system 1.

As will be explained in more detail below, the effectiveness of controller 30 depends in large part on the ability of the analytic method (for example, in the form of the aforementioned algorithm incorporated into controller 30) to accurately and rapidly predict corrective machine commands based on measured, calculated or a combination of measured and calculated strip surface dimensions that are indicative of strip profile, flatness or both. For example, in real-time operation (such as when a rolling mill is processing metal strip 5), valuable attributes of the present invention are that it can sense and correct deviations from a desired value of one or both of a profile and flatness of strip 5 with greater flexibility, rapidity and accuracy than conventional means. This means that, even for complex cluster-type mills, the desired dimensional quality of the rolled metal strip can be attained under high-speed rolling conditions by the corrective measures taken by the controller 30, machine commands 40 and related actuators, valves and other components used to adjust the rollers 10.

Figure 2:
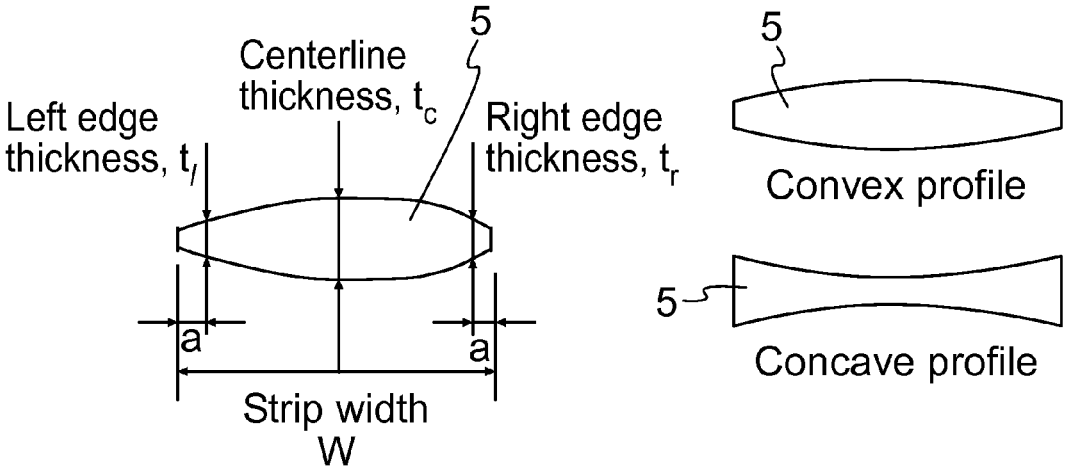
FIG. 2 shows basic definitions and examples of strip profile.

Referring next to FIG. 2, exaggerated forms of sample cross-sectional thickness profiles of metal strip 5 are shown. Measurements on the left and right sides $t_l$ and $t_r$, respectively, may be made a marginal distance a in from the ends. While the term strip "profile" refers to the general cross-sectional nature of the strip, a widely used metric to represent strip profile is the strip crown SC, which is the center thickness $t_c$ less an average value of the left and right side thicknesses $t_l$ and $t_r$ as shown by the following formula:

$$SC=t_c-(t_l+t_r)/2.$$

Figure 3:
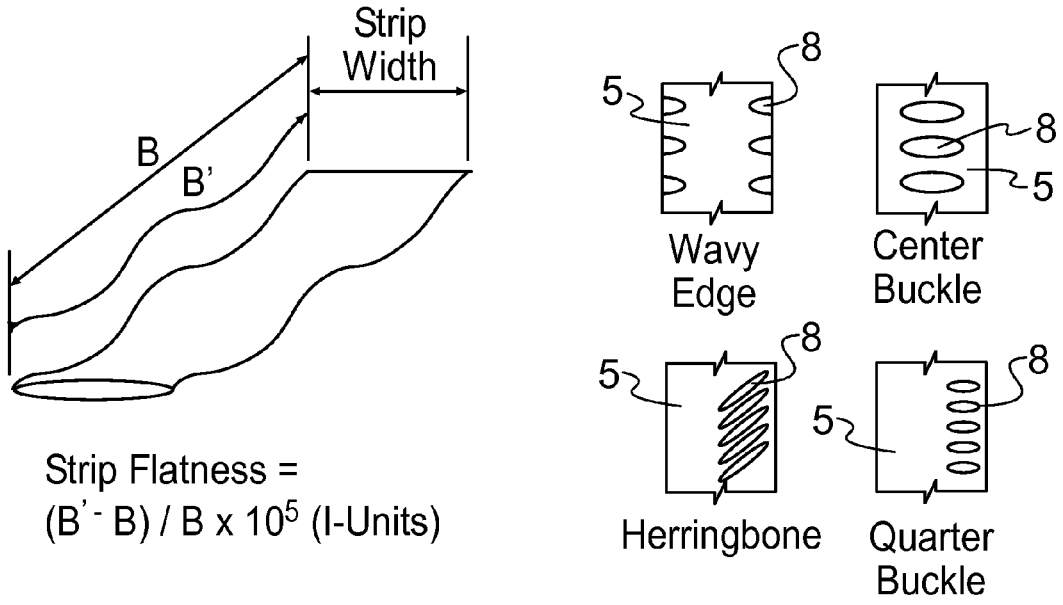
FIG. 3 shows basic definitions and examples of strip flatness.

Referring next to FIG. 3, strip flatness is a variation in the length, shown as the difference between the length B' along the surface contour and the actual length B, of the metal strip 5 across the width w direction. A section of strip 5 having perfect flatness will lie on a perfectly flat surface with continuous contact between them. Strip 5 having less than perfect flatness will commonly exhibit defects 8 in the form of patterns of loose areas manifested in the form of wavy edge, center buckle, quarter buckle and herringbone buckle, all as shown in the figure. Strip 5 profile and flatness are related due to the principle of mass conservation, and because plastic deformation of the strip 5 is an incompressible process. Nevertheless, a direct relation between profile and flatness is absent, largely due to varying degrees of strip 5 width expansions occurring simultaneously with thickness reduction. The strip flatness SF is shown by the following formula (where the multiplication factor $10^5$ amplifies the nominal flatness to industry-standard "I-units"):

$$SF=(B'-B)/B*10^5.$$

Figure 4:
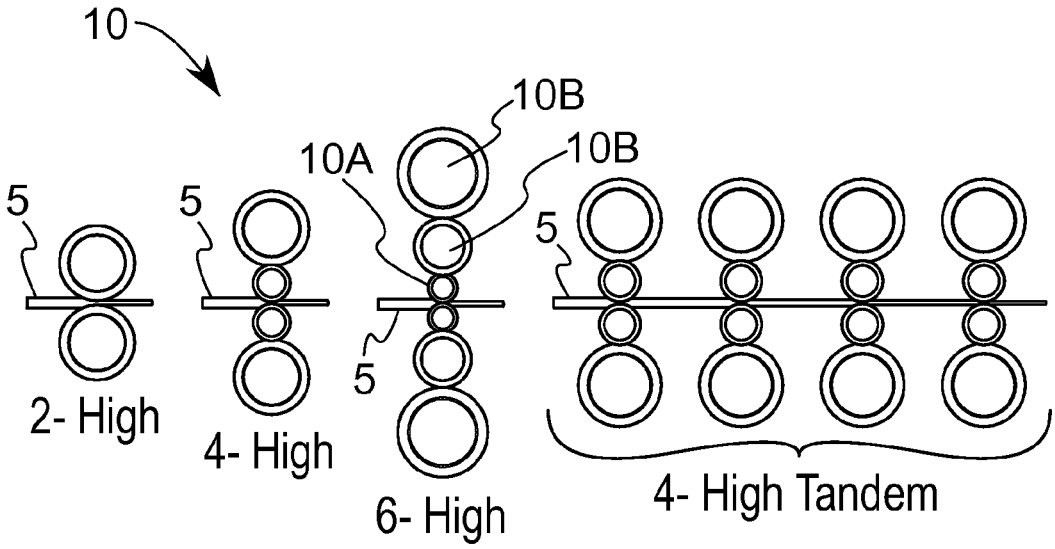
FIG. 4 shows side views of various non cluster-type rolling mills.
Figure 5:
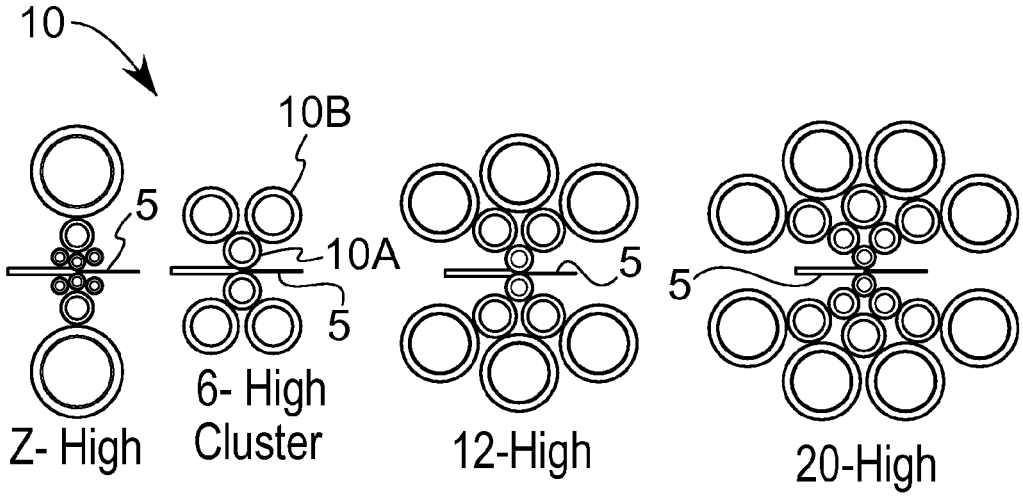
FIG. 5 shows side views of various cluster-type rolling mills.

Referring next to FIGS. 4 and 5, examples of various rolling mills are shown. Referring with particularity to FIG. 4, non cluster-type rolling mills, including 2-high, 4-high, 6-high and 4-high tandem, are shown. In all of these examples, the axes of all rollers 10 are coincident in the vertical direction. Referring with particularity to FIG. 5, cluster-type rolling mills are shown, wherein the axes of the rollers 10 are not inclusively coincident in the vertical direction. Specific examples shown include Z-high, 6-high, 12-high and 20-high. It will be understood by those skilled in the art that the rolling mills and roller configurations depicted in FIGS. 4 and 5 are exemplary, not exhaustive, and that other configurations are compatible with the present invention.

Figure 6:
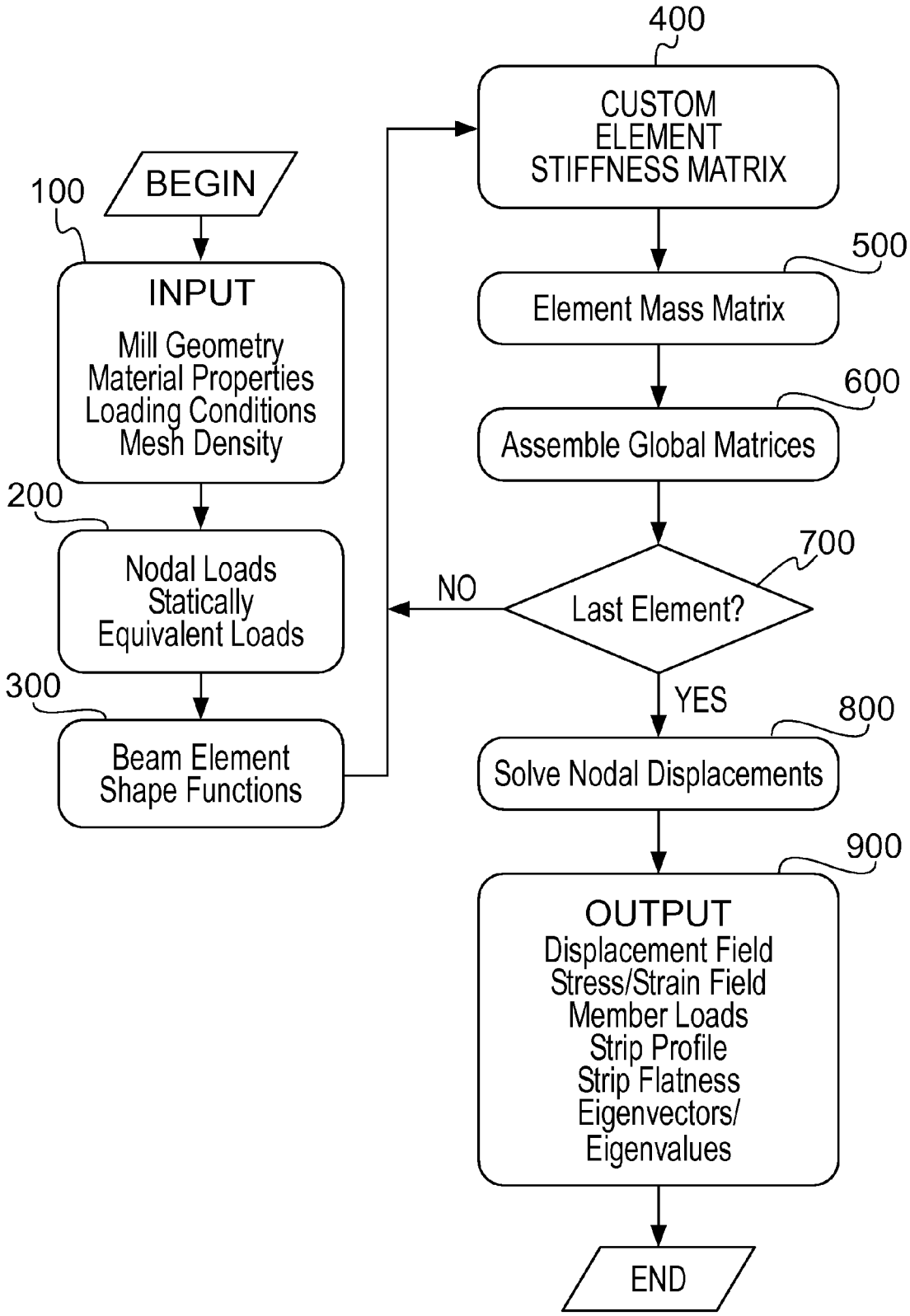
FIG. 6 shows a flowchart of a method of determining strip profile, flatness or both according to the invention of FIG. 1.
Figure 9:
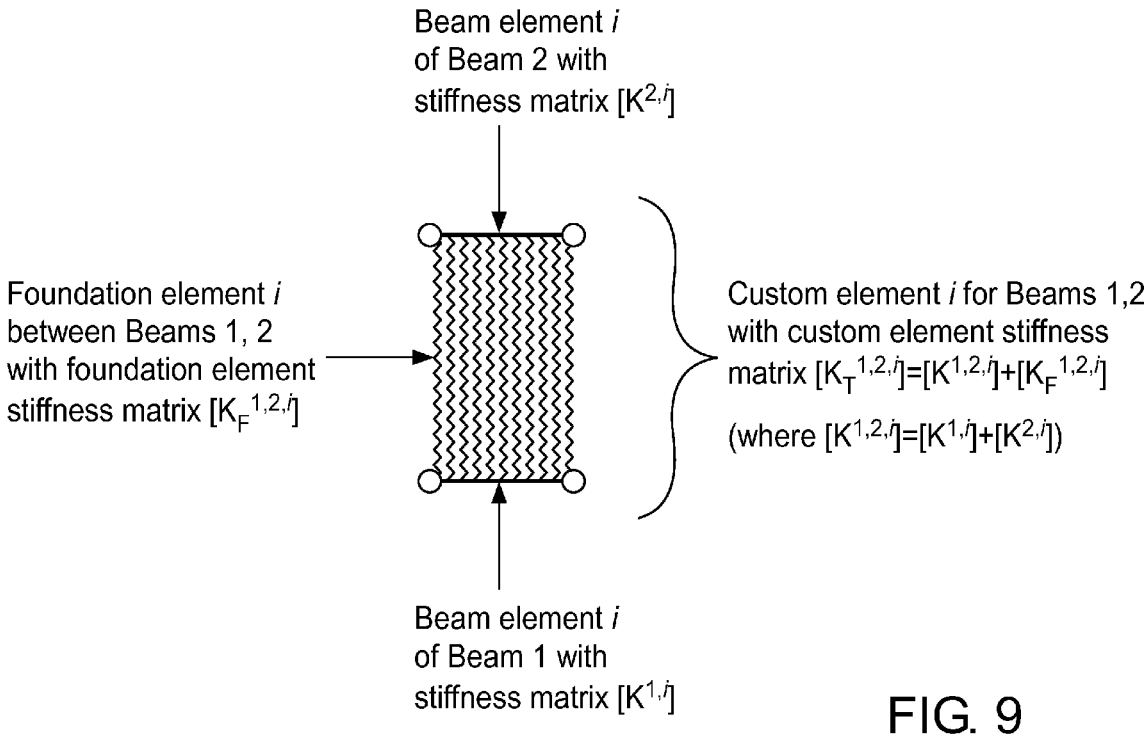
FIG. 9 shows a custom element stiffness matrix according to an embodiment of the present invention.

Referring next to FIGS. 6 and 9, a block diagram of how to determine strip profile and flatness, as well as a schematic representation of a stiffness model between two beam elements, are shown. Referring with particularity to FIG. 9, a schematic of the custom finite element stiffness matrix $[K_T^{1,2,i}]$ and its three main components (i.e., two Timoshenko beam stiffness matrices $[K^{1,i}]$, $[K^{2,i}]$ and a foundation element stiffness matrix $[K_F^{1,2,i}]$) is shown. The custom finite element stiffness matrix $[K_T^{1,2,i}]$ is a sum of the corresponding stiffness matrices of the three components. Referring with particularity to FIG. 6, the manner in which the system 1 of FIG. 1 is used in conjunction with an algorithm to compute mill deflection, strip profile and related flatness based on an aggregation of the numerous custom finite element stiffness matrices of FIG. 9 is shown. It will be appreciated by those skilled in the art that the components (100 to 900 in FIG. 6) of such an algorithm can be reordered without a change in the output 900, and further such an algorithm can be made up of one or more program code segments that can run on conventional data processing and related computational devices, including microprocessor-based computers or the like. Program code is preferably in a computer-readable format, and can be stored on a computer-readable medium, such as computer memory or conventional devices, including flash memory, CD-Rom, floppy disks or the like, as well as by a propagated signal, such as those that link, by communications network (such as the internet), program code from a remote source location, such as a server or other host device. Such computational devices and the algorithms configured to run on them may be part of controller 30, which was discussed above in conjunction with FIG. 1. Various geometric, material property, load conditions and mesh fineness attributes are input in step 100, after which statically equivalent nodal loads and nominal nodal loads are assigned in step 200. The assignment of statically equivalent nodal loads exploits an advantage from the conventional finite element method whereby force and moment loads can be accurately assigned regardless of the element mesh density (i.e. number of elements). Beam element shape functions are determined in step 300, and are used to calculate the foundation element stiffness matrices $[K_F^{1,2,i}]$ (discussed previously) and to compute continuous displacement functions after solution of a nodal displacement vector [u] discussed in more detail below.

Specific to the present invention is the incorporation of a custom finite element stiffness matrix, shown in step 400, which couples conventional beam element stiffness matrices with elastic foundation matrices containing foundation moduli obtained from existing solid mechanics solutions or solutions from other relevant means. The custom finite element stiffness matrix of step 400 realizes the benefits of a conventional finite element method, while not requiring the enormity of elements traditionally required to model rolling mill components and other complex shapes. In the traditional finite element approach, a large number of small elements are required to accurately model the extremely narrow contacting interface lines between adjacent rollers 10A, 10B and between the working rollers 10A and the strip 5. In contrast, the present invention replaces this requirement with large, coupled, continuous elastic foundations that are expressed in a novel manner as to fit the traditional finite element format. These are expressed in a novel manner in that while the use of single beam finite element analysis with a single elastic foundation is known, the present inventors are not aware of any use of multiple beams and multiple continuous elastic foundations between such multiple beams to achieve the degree of flexibility, speed and accuracy needed to predict and optionally correct profile and thickness deviations in rolled strip 5.

These elastic foundations inherently represent existing accurate analytical solutions of the contacting conditions between adjacent rollers 10A, 10B and between the working rollers 10A and the strip 5, thereby allowing the use of large custom elements and avoiding the use of many small conventional finite elements. Thus, by the use of the custom finite element stiffness matrix in step 400 rather than a traditional finite element method, operational flexibility is enhanced, including for the aforementioned real-time rolling mill operations. In the present context, the term "custom finite element" and its variants is used for clarity of description, and generally designates a procedure that, while operating in a manner generally similar to conventional finite element approaches, also includes features to allow its use under real-time applications, such as during the operation of a rolling mill. It will be understood by those skilled in the art that the present invention employs such a customized finite element approach, and further that the lack of the use of such a term in every instance of the described system does not detract from the novelty or spirit of the invention.

The custom finite element stiffness matrix produced in step 400, designated $[K_T^{1,2,i}]$ and briefly introduced in conjunction with FIGS. 6 and 9 above, for two arbitrary beam elements 1 and 2, which may be used to model the relationship between one or more sections of adjacent rollers 10A and 10B or between working rollers 10A and the strip 5, has a maximum size of twenty four by twenty four when considering all six degrees of freedom per node (i.e., two nodes per beam times two beams times six degrees of freedom per node), and is defined as:

$$[K_T^{1,2,i}]=[K^{1,2,i}]+[K_F^{1,2,i}] \quad (1)$$

where $$[K^{1,2,i}] = \begin{bmatrix} [K^{1,i}] & [0] \\ [0] & [K^{2,i}] \end{bmatrix} \text{ and} \tag{2}$$

$$[K_F^{1,2,i}] = \begin{bmatrix} \left[\int_0^L k(x)F_{11}(x)dx\right] & -\left[\int_0^L k(x)F_{12}(x)dx\right] \\ -\left[\int_0^L k(x)F_{21}(x)dx\right] & \left[\int_0^L k(x)F_{22}(x)dx\right] \end{bmatrix} \tag{3}$$

$$F_{ij}=N_{vi}^T N_{vj}\sin^2\theta+N_{wi}^T N_{wj}\cos^2\theta+N_{vi}^T N_{wj}\sin\theta\cos\theta+N_{wi}^T N_{vj}\sin\theta\cos\theta \tag{4}$$

As shown in EQN. 1, each individual customized finite element stiffness matrix $[K_T^{1,2,i}]$ represents the coupled displacements of arbitrary beams 1 and 2, and is obtained by combining the conventional element stiffness matrices $[K^{1,2,i}]$ for two Timoshenko beams with coupling element matrices $[K_F^{1,2,i}]$ are derived from Winkler (i.e., mattress-type) elastic foundation terms. Stated another way, there are the three components (specifically, two Timoshenko or Euler-Bernoulli beam elements and a coupling elastic foundation) that are used to make up the corresponding component element stiffness matrices. In a more generalized form, $[K^{n,i}]$ represents a conventional element stiffness matrix (Timoshenko or Euler-Bernoulli) for beam n, element i, producing a twelve by twelve matrix size for six degrees of freedom per node, $N_{vn}$ represents a vertical displacement sub matrix shape function of Euler-Bernoulli or Timoshenko beam element shape function $N_n$ (n=1, 2), $N_{wn}$ is the horizontal displacement sub matrix shape function of Euler-Bernoulli or Timoshenko beam element shape function $N_n$ (n=1, 2), and θ is the angle of inclination between beams elements 1 and 2 and L is the length of beam elements 1 and 2 (shown with greater particularity in FIG. 7). Inclusion of the angle of inclination enables the capability of the method to include non-vertical stack rolling mills such as the 20-high rolling mill shown previously in FIG. 5. In EQN. 3, the term k(x) represents the Winkler foundation modulus between two beams, which may or may not be taken to be a function of axial position x.

After the determination of the custom finite element stiffness matrix in step 400, the element mass matrix of step 500 is optionally formed if dynamic analysis is required and the global matrices and in step 600 are formed. The global displacement-based linearized system, as represented generally by [K][u]=[f], where [K] is the global stiffness matrix, [u] is the nodal displacement vector and [f] is the load (or force) vector, is obtained by summing the contributions of the individual customized finite element stiffness matrices $[K_T^{1,2,i}]$ from EQN. 1 in a manner similar to that used in finite element methods. The global system equation [K][u]=[f] represents a linearization of the general rolling mill contact problem, which is nonlinear because the stiffness matrix [K] is dependent on the load vector [f] due to inclusion of foundation moduli k(x) in the global matrix [K], and because the k(x) terms are derived using the load vector [f]. Linearization provides many advantages, including rapid solution and superposition (addition) of individual nodal solutions based on individual load vectors that represent different machine operating conditions and/or profile and flatness actuator setpoints.

Figure 8:
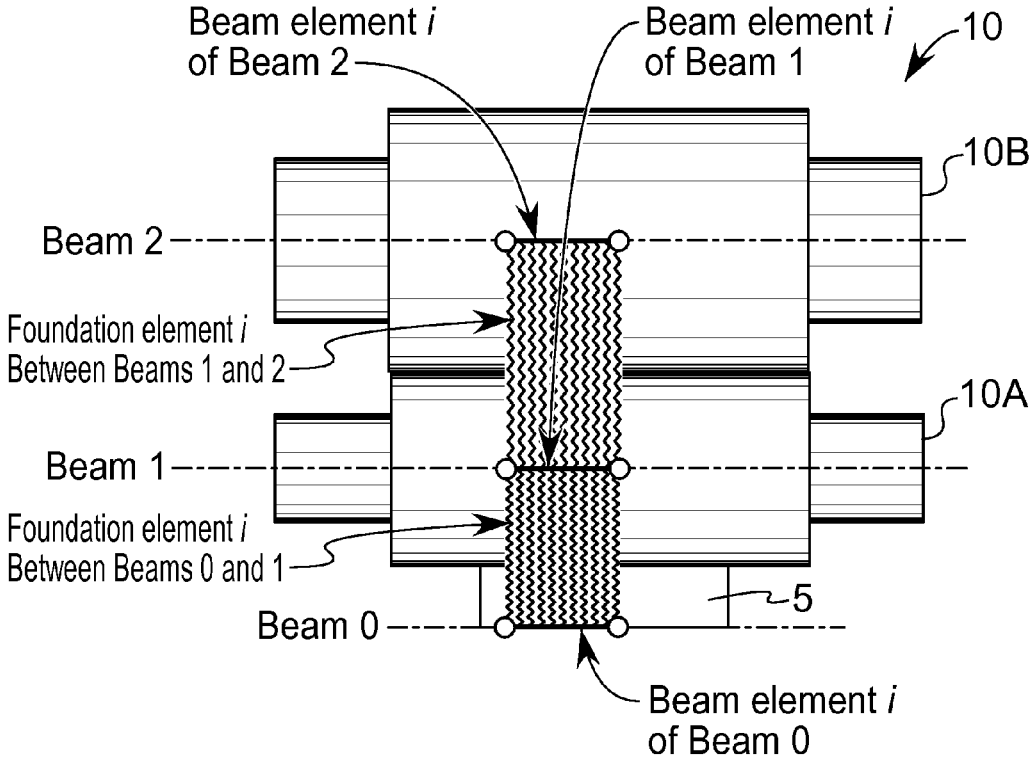
FIG. 8 shows the interactions among beam elements as modeled by the elastic foundations of FIG. 7.

A minimum of one finite element is required to model each roller 10 minimum of one finite element is required to model the strip 5, both as shown in FIG. 8. Additional elements may be used to improve accuracy without loss of generality. Steps 400 through 600 are repeated (shown as step 700) until all of the elements within the model are calculated. Once all element data has been calculated, nodal displacement values can be solved in step 800, after which step 900 produces output (which may include, among other things, displacement and stress/strain fields, member loads, eignenvectors/eigenvalues and ultimately strip profile and flatness) that may be used to report the condition of the portion of strip 5 that has been worked upon by rollers 10. Such output may additionally be used as part of a feedback-based control signal 40 that comes from controller 30 and can modify one or more operational parameters shown in FIG. 1 that are associated with the system 1.

The linearized global stiffness matrix-based system is valid in the vicinity of the expected nominal loading conditions of the mill stand. By modelling the deflection of rolling mill components based on the rolling loads necessary to induce reductions in strip 5 thickness or induce material tempering, the device and method of the present invention can provide significant improvements in quality of the strip 5. The generality of the deflection model enables consideration of customary rolling mill profile and flatness control mechanisms such as roll bending, roll shifting and roll crossing (all as shown as graphical representations of a corresponding control signal 40 in FIG. 1), in addition to roll mechanical crowning as well as the incidental effects of roll thermal crowning and roll wearing. By having the output data from the model fed back into one or more of these flatness control mechanisms, real-time (i.e., run-time) control of the rolling mill is possible, while maintaining the accuracy from traditional off-line methods (such as finite element approaches).

Referring again with particularity to FIG. 9, a schematic representation of such a model is shown. Construction of the global stiffness matrix [K], as shown in the repeated steps 400 through 600, is performed in part by representing individual rollers 10 of a given rolling mill as one or more conventional three-dimensional Timoshenko or Euler-Bernoulli beam finite elements. More particularly, contact interactions between adjacent rollers 10 are represented as continuous linear elastic foundations. In their fundamental form, these are Winkler (mattress-type) foundations, but which in their converted form become non-Winkler (non mattress-type) foundations as follows by adding global stiffness matrix modifying terms $\Delta k_{ij}$, which are defined as $$\Delta k^{ij}=(-\alpha_{ij})k_{ii} \tag{5}$$

where $\Delta k_{ij}$ is a change in global stiffness matrix at a location corresponding to degrees of freedom i and j, $\alpha_{ij}$ is the ratio of deflection at degree of freedom "j" for unit deflection at degree of freedom "i", which may be determined from any relevant method and $k_{ii}$ is the original global stiffness term for degree of freedom "i". A Winkler elastic foundation denotes a mattress-type foundation and in the present invention means that contact surface deflections between adjacent rollers 10A, 10B and the working rollers 10A and the strip 5 occur only at exact locations where contact surface loads are present. A non-Winkler or non mattress-type elastic foundation can provide enhanced accuracy because it represents the more realistic case where contact surface deflections occurs in the vicinity of the contact surface loads in addition to the exact location of the contact surface loads.

Such elastic foundations represent linearized load versus center-to-center deflection relationships of cylindrical bodies in lengthwise contact (such as may emulate the rollers 10), as may be determined from classical solid mechanics, experimentation, or any other relevant method. Construction of the global stiffness matrix [K] is completed by representing contact interactions between the working rollers 10 and the metal strip 5 by additional continuous linearized elastic foundations, which may be derived from any relevant method. As appropriate, any or all of the elastic foundations between separate rollers 10 (which include both work and backup rollers 10A and 10B) and between the work rollers 10A and the strip 5 may vary as a function of axial position along the respective rolls or as a function along the width w of the metal strip 5. The complete global stiffness matrix [K] is formed by summing the contributions of the individual customized finite element stiffness matrices (i.e. $[K_T^{1,2,i}]$ for each general element "i" and each of arbitrary beams 1 and 2) according to nodal locations in the conventional manner for the well-known finite element method.

Static solution of the global system using global stiffness matrix [K] with a specific load vector [f] yields nodal deflections [u] for the strip and rolling mill components, from which third order displacement fields can be computed (if desired) in the conventional manner by multiplying the conventional Euler-Bernoulli or Timoshenko beam element shape functions with the nodal deflection vector [u]. The strip 5 profile is assumed to coincide with the computed position of the common generator between the working rollers 10A and the strip 5. The strip/working roll common generators are the mutual contacting lines of the working rollers 10A and the strip 5. Hence, as is commonly assumed by those skilled in the art of rolling, the present invention assumes that the determination of the strip 5 profile is the same as the determination of the loaded gap profile between the working rollers 10A. Other common generators may represent the mutual contacting surface lines of adjacent rollers 10A, 10B. Each strip/working roll common generator is calculated by decomposing each elastic foundation between working rollers 10A and strip 5 into a series-combination of two distinct elastic foundations, then solving for the contact interface deflection using the distributed contact force and either one of the decomposed foundations. In this way, the accuracy of traditional finite element-based approaches is preserved, contact-type calculation problems are avoided, and only a tiny fraction of the computational time used by such approaches is required, thereby enabling computation and optional corrective measures (such as by controller 30) while the system 1 is operating.

Thus, compared to traditional finite element methods, the present approach has similar analytical programming structure, yet is much more compact. The compactness of the present invention differentiates it from the traditional finite element method where an enormity of very small finite elements are required to model the contacting interfaces between adjacent rollers 10A, 10B and between the working rollers 10A and the strip 5. For example, for the case of contact between adjacent rollers 10A, 10B, such enormity of elements is required with traditional finite elements since the contacting interfaces represent near line-contacting conditions, whereby the lengths of the contacting interfaces correspond to the axial lengths of the rollers 10 while the width of the contacting interface is nearly infinitely narrow (depending on contact load magnitude) because of the cylindrical cross-sections of the adjacent rollers 10. In contrast, the present invention employs a novel technique to represent the contact interactions between adjacent rollers 10A, 10B as continuous coupled elastic foundations derived from well-known solid mechanics solutions or other methods, meaning that the mutual deflection between adjacent rollers 10A, 10B can be represented by a relatively few numbers of customized finite elements that combine the effects of beam deflection properties and contact surface flattening properties. Having such similar analytical structure as those of traditional finite element methods makes the invented method easier to program than other alternative methods, while the use of continuous versus discrete contact interactions allows the computation of corrective measures in system 1 in real-time conditions, thereby facilitating the aforementioned corrective measures that a traditional finite element approach cannot.

Figure 7:
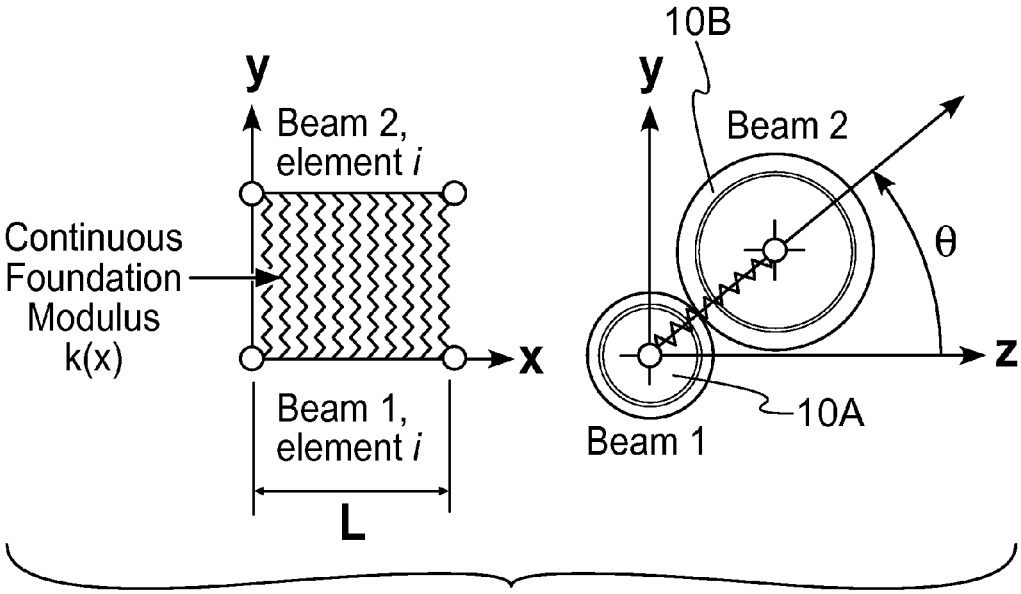
FIG. 7 shows a continuous elastic foundation between beam elements and angle of inclination between beam (roll) axes on cluster-type mills.

Referring next to FIGS. 7 through 8, a representation of the previously described custom finite element stiffness matrix $[K_T^{1,2,i}]$ into a model used to determine parameters for rollers 10 is shown. As stated above, the present approach combines the computational accuracy and capability advantages of traditional numerical finite element methods with analytical solid mechanics to create a fast, compact, linear, semi-analytical roll-stack deflection model capable of predicting both static and dynamic responses for various mill types and control mechanisms. By being semi-analytical, the necessity to operate a purely numerical algorithm is done away with, as classical analytic approaches, such as Hertzian or non-Hertzian contact formulae, may be employed. Referring with particularity to FIG. 7, a combination of two beam elements labelled "Beam 1" and "Beam 2" (representing, for example, the axes of rollers 10A and 10B or portions thereof, as shown in FIG. 1) and a coupled continuous elastic foundation between these beams is shown. The length of Beam 1 and 2 is designated L. As can be seen, the present invention can accommodate cluster-type rolling mills in addition to non cluster-type rolling mills (both described previously) by specification of an arbitrary angle of inclination, θ, between roller 10A and roller 10B.

Referring with particularity to FIG. 8, an arbitrary upper section of the rollers 10 of a notional 4-high rolling mill system 1 with adjacent rollers 10A and 10B and respective contact interactions modeled using the custom finite elements of the present invention is shown with an arbitrary mesh density. Since the strip 5 may be assumed to be an elastic foundation only with no associated beam properties, the corresponding beam element stiffness matrix $[K^{0,i}]$ for the strip 5 may correspond to a zero matrix of the same size. The use of a zero matrix for the beam element stiffness matrix of the strip 5 enables the present invention to fit the traditional finite element method without special modifications. In addition, to avoid duplication of beam element stiffness contributions for adjacent custom finite elements, a zero matrix is similarly substituted. Thus, for example if custom finite element stiffness matrix $[K_T^{1,2,i}]$ contains non-zero beam element contributions $[K^{1,i}]$ and $[K^{2,i}]$ of beams 1 and 2 respectively, then custom finite element stiffness matrix $[K_T^{0,1,i}]$ will use a zero matrix for beam element contribution $[K^{1,i}]$.

In constructing a general static model, each roll of a multi-roll stack, such as those shown in the upper half of the 4-high mill system 1 of FIG. 8, is represented by one or more 3D Timoshenko beams that comprise several degrees of freedom, which include all translational and rotational components to model axial deflection, bending deflection, and torsional deflection. The flattening contact interactions between rollers 10A and 10B are represented by elastic coupling of degrees of freedom in the finite element matrix, using Winkler elastic foundations (or optionally non-Winkler elastic foundations as discussed previously, but hereafter included in the discussions pertaining to Winkler foundations). The Winkler foundation moduli for interactions between rollers 10A and 10B can be obtained from existing formulations representing Hertzian or non-Hertzian contact between cylinders, from physical experiment, or from commercial finite element studies. Winkler foundations for interactions between the work rollers 10A and the strip 5 can be obtained using sensitivities of unit rolling force with respect to strip thickness reduction from rolling force models from physical experiment, or from commercial (i.e., traditional) finite element studies.

The elastic foundation moduli, k(x), of EQN. 3, represent linearized spring-constants in the relationship between force per unit beam length and displacement between the beam centers (roll-roll and roll-strip). As such, they actually represent the equivalent (series-combined) foundation moduli of two individual beam foundations $k_1(x)$ and $k_2(x)$—obtained from either two rollers 10 or one roller 10 and the strip 5. These equivalent foundation moduli can be taken as constants or functions of axial position "x", as may be derived from any given state of unit force which itself is a function of the axial position "x". In addition, elastic foundation moduli k(x) can take into account existing roll crowns (combining mechanical grinding and thermal or wear effects) as well as pair-cross and roll-shifting crown-control mechanisms, and applied strip tension distributions via their relation with unit rolling force. If desired, for repeated static deflection calculation with the linearized model, foundation moduli k(x), may be updated based on unit force distributions from a prior calculation to obtain a load-converged solution. The latter option is typically applied in the case of predicted loss of contact between rollers 10A, 10B or between rollers 10A and strip 5.

Loading of the mill deflection model with forces, moments or both can be applied in two ways. First, loads applied at positions that correspond to nodal locations can be directly applied to nodal degrees of freedom. Second, concentrated or distributed loads not corresponding to nodal locations can be converted into statically equivalent nodal loads. Use of statically equivalent loading is very convenient for use with arbitrary element lengths.

Solution of the nodal displacement vector [u] from the global system equation [K][u]=[f] may be accomplished by a variety of methods, such as Gaussian elimination or matrix inversion of [K] (if reasonable). It may be convenient and reasonable to use the matrix inversion method of solution in cases where repeated solutions of nodal displacement vector [u] are required for small perturbations in the nominal load vector [f], such as for strip flatness control gain matrix determination, pass schedule optimization, or other requirements. The use of matrix inversion is reasonable if the foundation moduli are not highly nonlinear functions of the corresponding load, as has been shown for the case of deflection between roll centers at typical magnitudes of rolling force. In this case, matrix inversion needs to be performed only once, and repeated solutions are obtained using matrix multiplication.

Following solution of the displacement field, the unit rolling force distribution between adjacent rollers 10A, 10B or between the work rollers 10A and strip 5 is easily calculated by multiplying the corresponding foundation modulus with the displacement between respective beam axes. The common generator displacement between the work rollers 10A and the strip 5 determines the transverse thickness profile (crown) of the rolled strip.

A significant advantage of the present invention in modeling roll-stack deflection is the ability to predict the dynamic response (i.e., vibration characteristics) of rolling mills. By constructing a global mass matrix [M] and optionally a global damping matrix [C] in addition to the linearized global stiffness matrix [K], the standard eigenvalue problem can be solved to obtain the natural frequencies and mode shapes of vibration. Natural frequencies are important in mill design to avoid excessive vibration (such as mill "chattering") and concomitant structural failure. Because of linearization, the natural mode shapes of vibration at a given static loading condition can be obtained by superposition of the no-load mode shapes with the statically determined displacements. Using widely known methods, the response to harmonic loading, response history, and spectral response of the rolling mill structure can be readily obtained using the global stiffness matrix [K], the global mass matrix [M], and for some cases, a user-defined global damping matrix [C].

By virtue of linearization and the ability to be incorporated in a manner similar to conventional finite element methods, dynamic analysis using the method of the present invention is straightforward. Vibratory characteristics are important in rolling mill design, vibration troubleshooting, and the design of ancillary control systems. Although not traditionally considered in the prediction of profile and flatness, by encompassing all six degrees of freedom, the invented method accommodates static and dynamic torsional deflection prediction and control simply by assigning continuous elastic foundations for the torsion degrees of freedom in a similar manner to the elastic foundations discussed previously.

Thus described is an analytical method that can be incorporated into a system to predict and optionally control strip profile and flatness in an operating rolling mill. Among the other beneficial uses introduced earlier, for on-line automated control systems, the method in accordance with the present invention provides an accurate and rapid means for computing transfer functions to address error signals between measured and the desired (i.e., target) profile or flatness. Flexibility of the present method is realized by the way in which loads (forces, moments, displacements), either distributed or concentrated, may be applied as statically equivalent nodal loads when not coincident with mesh node locations.

To further increase accuracy in the determination of strip 5 profile and flatness, the computed mill deflections may be used to update the model geometry and recalculate pertinent model parameters. For instance, elastic foundation values may be updated according to foundation load profiles from a prior computation. Hence, the present approach may be applied in an iterative manner until chosen convergence criteria are met.

The foregoing detailed description and preferred embodiments therein are being given by way of illustration and example only; additional variations in form or detail will readily suggest themselves to those skilled in the art without departing from the spirit of the invention. Accordingly, the scope of the invention should be understood to be limited only by the appended claims.

What is claimed is:

1. An article of manufacture comprising a computer usable medium having computer readable program code embodied therein for determining at least one of a profile value and a flatness value of a metal strip, wherein said metal strip exists in a first state prior to passage through a rolling mill and a second state after passage through said rolling mill such that said second state is possessive of at least one surface dimension different than that of said first state, said code configured such that displacement values of said metal strip and at least one component of said rolling mill corresponding to said at least one of a profile value and a flatness value associated with said second state are generated based on input parameters that identify a relationship between said rolling mill and said metal strip, said code further configured such that said rolling mill and said metal strip are modeled as a combination of a plurality of beam elements and a plurality of continuous elastic foundations coupled between said plurality of beam elements.

2. The article of manufacture of claim 1, wherein said input parameters that identify a relationship between said rolling mill and said metal strip comprise at least one of a load, material properties and geometry of said metal strip and rolling mill.

3. The article of manufacture of claim 2, wherein said displacement values are calculated based on a product of said load and an inverse of stiffness aggregated over said plurality of beam elements and said plurality of continuous elastic foundations.

4. The article of manufacture of claim 1, wherein said code further causes the computer to compare said generated displacement values to a measured set of displacement values.

5. The article of manufacture of claim 4, wherein said computer readable program code further causes the computer to instruct said rolling mill to change at least one relationship between rollers contained therein such that said at least one of a profile value and a flatness value associated with said second state of said metal strip is adjusted.

6. The article of manufacture of claim 5, wherein said changed relationship between rollers is selected from the group consisting of roll crossing, roll bending and roll shifting.

7. The article of manufacture of claim 1, wherein said computer readable program code further causes the computer to calculate vibratory response characteristics of at least one component of a system comprising said metal strip and said at least one component of said rolling mill.

8. The article of manufacture of claim 7, wherein said computer readable program code is further configured such that vibratory response characteristics calculated by the computer are based on a superposition of at least one calculated value of eigenvectors onto said displacement values.

9. The article of manufacture of claim 1, wherein said computer readable program code is further configured to iteratively operate to calculate said displacement values of said metal strip in said second state and said at least one rolling mill component.

* * * * *

UNITED STATES PATENT AND TRADEMARK OFFICE

CERTIFICATE OF CORRECTION

PATENT NO. : 7,823,428 B1
APPLICATION NO. : 11/686381
DATED : November 2, 2010
INVENTOR(S) : Arif S. Malik et al.

It is certified that error appears in the above-identified patent and that said Letters Patent is hereby corrected as shown below:

Col. 11, Line 11, insert --and-- at the beginning of the line.

Signed and Sealed this
Eighteenth Day of October, 2011

David J. Kappos

David J. Kappos
*Director of the United States Patent and Trademark Office*